US005564910A

United States Patent [19]

Huh

[11] Patent Number: 5,564,910

[45] Date of Patent: Oct. 15, 1996

[54] ROTARY COMPRESSOR HAVING MUFFLER WITH GAS DISCHARGE OUTLETS

[75] Inventor: Man-Sun Huh, Kwacheon, Rep. of Korea

[73] Assignee: Samsung Electronics Co., Ltd., Suwon, Rep. of Korea

[21] Appl. No.: 322,334

[22] Filed: Oct. 13, 1994

[30] Foreign Application Priority Data

Oct. 14, 1993 [KR] Rep. of Korea ..... 93-21090

[51] Int. Cl.[6] ..... F04B 21/00

[52] U.S. Cl. ..... 417/312; 181/403

[58] Field of Search ..... 417/312; 181/403

[56] References Cited

U.S. PATENT DOCUMENTS 4,884,956 12/1989 Fujitani et al. ..... 417/312

5,203,679 4/1993 Yun et al. ..... 417/312

FOREIGN PATENT DOCUMENTS 61-152793 9/1986 Japan .

*Primary Examiner*—Charles G. Freay

*Attorney, Agent, or Firm*—Burns, Doane, Swecker & Mathis, L.L.P.

[57] ABSTRACT

The present invention relates to a motor-driven rotary compressor provided with a muffler. The muffler is provided with gas discharge outlets which are inclined so that the gaseous discharge creates a force for augmenting the rotation of the rotor and thereby reducing the power consumption.

2 Claims, 2 Drawing Sheets

ROTARY COMPRESSOR HAVING MUFFLER WITH GAS DISCHARGE OUTLETS

FIELD OF THE INVENTION

The present invention relates to a rotary compressor provided with a muffler having gas discharge outlets.

A conventional rotary compressor comprises a shell member 1, a compressing cylinder 2 attached to an inside lower part of said shell member 1, a muffler 4 formed with two outlets 4*a* disposed to opposite sides of the rotor axis for discharging refrigerant gas so that a pressure pulsation in the refrigerant gas discharged from the compressing cylinder 2 is attenuated, and is discharged to an inner space 3 of the shell member 1, and a motor 7 having a stator 5 and a rotator 6, as shown in FIG. 1. The rotor 6 rotates a compressing member (not shown) disposed in the cylinder for compressing.

However, this type of rotary compressor has a problem in that it generates vibration and noise, and furthermore, does not smoothly rotate the rotor 6 because outlets 4*a* are parallel with the axis of rotation when the refrigerant gas is discharged to the inner space of the shell member.

Japanese Utility Model laid-open publication No. Sho 61-152793 disclosed a known hermetic vibration compressor, The hermetic vibration compressor disclosed in Sho 61-152793, comprises a motor, a rotary compressor disposed in a hermetic container in order to be operated by said motor, a bearing support plate having a tapered contact surface, and a muffler closed to said bearing support plate.

While this type of hermetic vibration compressor has an advantage in that it may improve a hermetic efficiency on account of the shape of the contact surface between the bearing support plate and the muffler, nevertheless, it has a problem in that it not only generates a terrible noise from the inner side of the hermetic container, but also the motor may not be rotated smoothly.

SUMMARY OF THE INVENTION

It is, therefore, an object of the present invention to provide a rotary compressor in which the above problems can be overcome and which exhibits decreased power consumption as well as less noise from the inner space of the shell member.

In accordance with an embodiment of this invention, the above object can be accomplished by a rotary compressor comprising: a shell member, a compressing cylinder attached on an inside lower part of said shell member, a muffler formed with two outlets so that a refrigerant gas discharged from said compressing cylinder is discharged to an inner space of said shell member through the outlets, and a motor having a stator and a rotor, wherein said muffler is provided with two projected outlets arranged in opposite directions from each other so that not only noise is decreased, but also a rotation force of said motor is increased when the refrigerant gas is discharged toward said inner space of said shell member.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF A PREFERRED EMBODIMENT OF THE INVENTION

Figure 1:
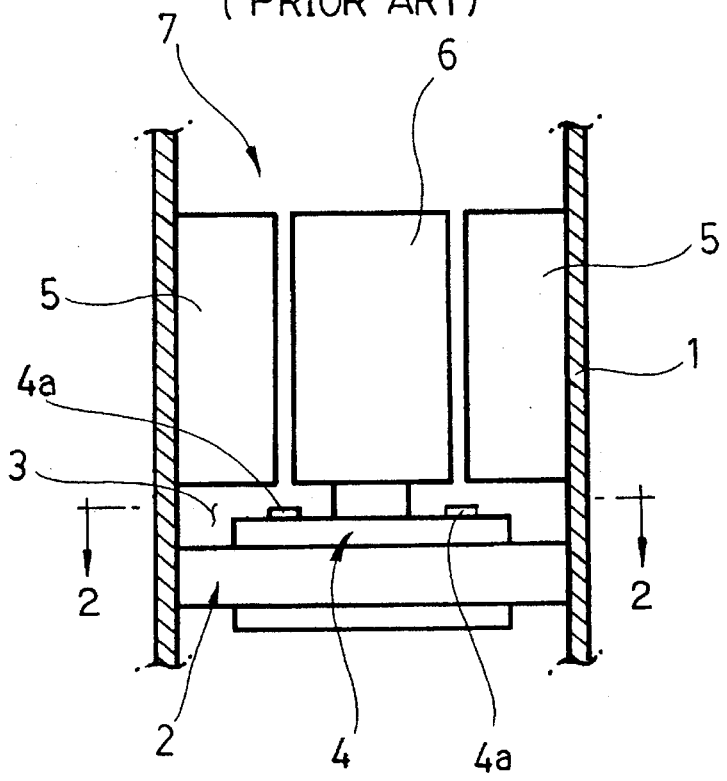
FIG.1 (PRIOR ART)
FIG. 1 is a schematic sectional view of the prior art.
Figure 2:
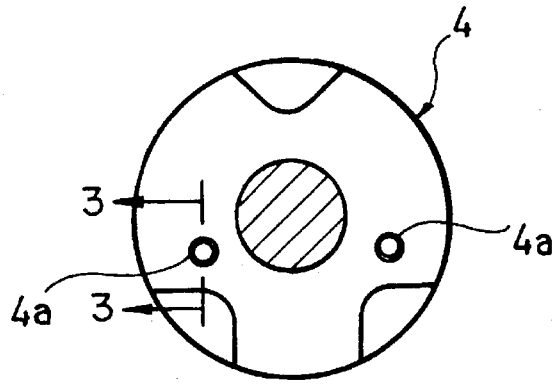
FIG.2 (PRIOR ART)
FIG. 2 is a sectional view along line 2—2 of FIG. 1.
Figure 3:
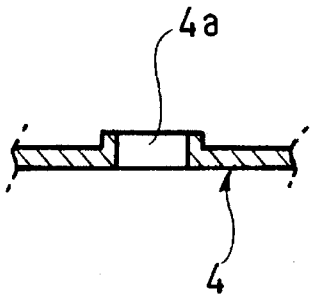
FIG.3 (PRIOR ART)
FIG. 3 is a sectional view along line 3—3 of FIG. 2.

An embodiment of the present invention will now be described in detail with reference to the accompanying drawings. Elements that are the same as shown in FIG. 1 are given the same reference numerals.

Figure 4:
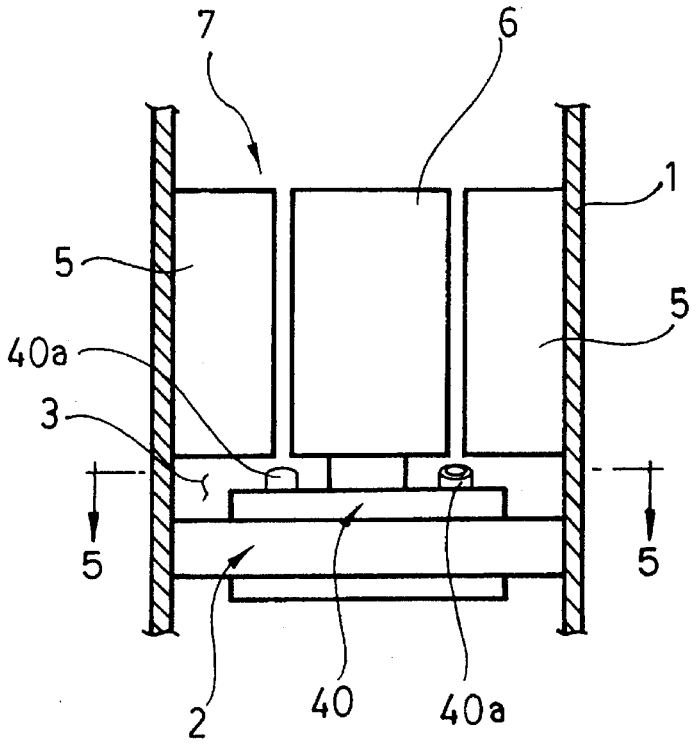
FIG. 4 is a schematic sectional view of the present invention.

As shown in FIG. 4, a rotary compressor in accordance with the present invention, comprises a housing or shell member 1 for forming an inner space 3, a compressing cylinder 2 attached on an inside lower part of said shell member 1, and a muffler 40 formed with two outlets 40*a* disposed to opposite sides of the rotor axis so that a pressure pulsation in the compressed refrigerant gas is attenuated and discharged to the inner space of the shell member 1. A motor having a stator 5 rotates a rotor 6. The rotor rotates a compressing member (not shown) disposed in the cylinder 2 in a conventional manner.

The outlets 40*a* are projected and directed opposite to each other.

Figure 6:
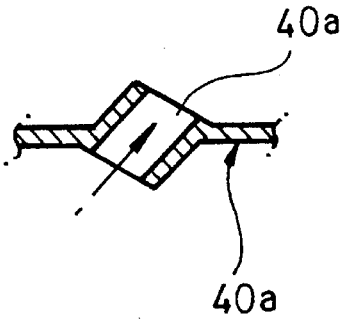
FIG. 6 is a sectional view along lines 6—6 of FIG. 5.

At this time, the outlets 40*a* are directed at a slant to a plane of the muffler 40 (i.e., a plane oriented perpendicular to the axis of the rotor) at a predetermined acute angle $\beta$ as shown in FIG. 6.

Next, the operation of the rotary compressor as above constructed will be described.

When the compressing cylinder 2 is operated, the refrigerant gas is compressed to become a high temperature and high pressure gas by the compressing cylinder 2.

The compressed refrigerant gas flows into the muffler 40 through a discharging valve (not shown) in order to decrease the pressure pulsation in the high temperature and pressure refrigerant gas.

Figure 5:
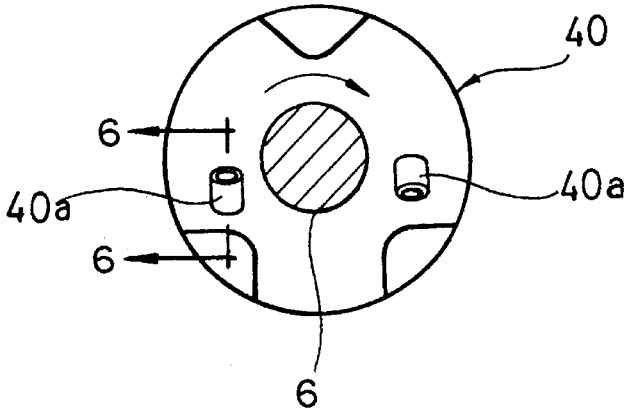
FIG. 5 is a sectional view along line 5—5 of FIG. 4.

The refrigerant gas with decreased pressure pulsation is rapidly discharged to the inner space 3 through the two outlets 40*a* in opposite directions to each other, as shown in FIG. 5.

At this time, noise can be remarkably decreased because the outlets 40*a* are projected in opposite directions to each other when the refrigerant gas is discharged to the inner space 3 through the outlets 40*a*.

That noise reduction occurs because the noise is dispersed in opposite directions.

Furthermore, not only can the rotation force of the rotor be increased but also the power consumption for rotating the rotor 6 can be remarkably decreased because the discharging directions of the gas are the same as the rotation direction of the rotor 6 when the refrigerant gas is discharged to the inner space 3.

As described above, according to the present invention, the power consumption as well as the noise generated in the inner space can be remarkably decreased.

Having described a specific preferred embodiment of the invention with reference to the accompanying drawings, it is to be understood that the invention is not limit to that precise embodiment, and that various changes and modifications may be effected therein by one skilled in the art without departing from the scope or spirit of the invention as defined in the appended claims.

What is claimed is:

1. In a rotary compressor comprising a housing forming an inner space; a motor, including a stator and a rotor, mounted within the space; a compressor mounted within the space and connected to the rotor to be driven thereby for compressing a refrigerant gas; and a noise muffler mounted within the space for attenuating pressure pulses of the gas, the muffler including a pair of outlets disposed to opposite sides of the rotor axis for discharging the gas into the space; the improvement wherein the outlets are arranged to discharge gas in generally opposite directions each corresponding to the direction of rotation of the rotor for augmenting the rotary drive force of the rotor.

2. In the rotary compressor according to claim 1 wherein each of the outlets of the improvement forms an acute angle with respect to a plane of the muffler oriented perpendicular to an axis of rotation of the rotor.

* * * * *